US006856286B2

(12) United States Patent
Jo et al.

(10) Patent No.: US 6,856,286 B2
(45) Date of Patent: Feb. 15, 2005

(54) DUAL BAND SPIRAL-SHAPED ANTENNA

(75) Inventors: Young-Min Jo, Palm Bay, FL (US); Young-Ki Kim, Palm Bay, FL (US); Frank M. Caimi, Vero Beach, FL (US); John Charles Farrar, Indialantic, FL (US); Mark D. Nelson, Satellite Beach, FL (US); Kerry Lane Greer, Palm Bay, FL (US)

(73) Assignee: SkyCross, Inc., Melbourne, FL (US)

( * ) Notice: Subject to any disclaimer, the term of this patent is extended or adjusted under 35 U.S.C. 154(b) by 5 days.

(21) Appl. No.: 10/285,291

(22) Filed: Oct. 31, 2002

(65) Prior Publication Data

US 2003/0117325 A1 Jun. 26, 2003

Related U.S. Application Data

(60) Provisional application No. 60/338,527, filed on Nov. 2, 2001, and provisional application No. 60/354,828, filed on Feb. 6, 2002.

(51) Int. Cl.[7] ..... H01Q 1/38; H01Q 1/24

(52) U.S. Cl. ..... 343/700 MS; 343/702; 343/895

(58) Field of Search ..... 343/766, 700 MS, 343/895, 846, 829, 793, 795, 702; H01Q 1/38, 1/24

(56) References Cited

U.S. PATENT DOCUMENTS

| | | | | | |
|---|---|---|---|---|---|
| 4,847,625 | A | | 7/1989 | Dietrich et al. | 343/700 MS |
| 4,903,326 | A | * | 2/1990 | Zakman et al. | 455/575.7 |
| 5,313,216 | A | | 5/1994 | Wang et al. | 343/700 MS |
| 5,497,164 | A | | 3/1996 | Croq | 343/700 MS |
| 5,680,144 | A | | 10/1997 | Sanad | 343/700 MS |
| 5,691,731 | A | | 11/1997 | van Erven | 343/742 |
| 5,929,825 | A | | 7/1999 | Niu et al. | 343/895 |
| 6,005,525 | A | | 12/1999 | Kivela | 343/702 |
| 6,094,170 | A | | 7/2000 | Peng | 343/700 MS |
| 6,137,445 | A | | 10/2000 | Ha et al. | 343/702 |
| 6,137,453 | A | | 10/2000 | Wang et al. | 343/895 |
| 6,166,694 | A | | 12/2000 | Ying | 343/702 |
| 6,229,487 | B1 | | 5/2001 | Sadler et al. | 343/700 MS |
| 6,353,443 | B1 | * | 3/2002 | Ying | 345/702 |
| 6,476,769 | B1 | * | 11/2002 | Lehtola | 343/702 |
| 2001/0002035 | A1 | | 5/2001 | Kayanakis | 235/492 |

* cited by examiner

*Primary Examiner*—Don Wong
*Assistant Examiner*—Trinh Vo Dinh
(74) *Attorney, Agent, or Firm*—John L. DeAngelis, Jr.; Beusse Brownlee Wolter Mora & Maire, P.A.

(57) ABSTRACT

A planar antenna comprising a spiral conductive surface comprising an inner spiral segment and an outer spiral segment. A shorting leg for connection to a ground plane and a feed leg responsive to the antenna signal (in the transmit and the receive modes) extend downwardly from the plane of the spiral segments. Performance characteristics of the antenna are responsive to the configuration and spacing of the spiral segments and the distance between the antenna and the ground plane.

32 Claims, 9 Drawing Sheets

DUAL BAND SPIRAL-SHAPED ANTENNA

This patent application claims the benefit of the Provisional Patent Application No. 60/338,527 filed on Nov. 2, 2001, and the Provisional Patent Application No. 60/354,828 filed on Feb. 6, 2002.

FIELD OF THE INVENTION

The present invention is directed generally to antennas for receiving and transmitting radio frequency signals, and more particularly to spiral-shaped antennas operative in multiple frequency bands.

BACKGROUND OF THE INVENTION

It is generally known that antenna performance is dependent upon the size, shape and material composition of the constituent antenna elements, as well as the relationship between certain antenna physical parameters (e.g., length for a linear antenna and diameter for a loop antenna) and the wavelength of the signal received or transmitted by the antenna. These relationships determine several antenna operational parameters, including input impedance, gain, directivity, signal polarization, operating frequency, bandwidth and radiation pattern. Generally for an operable antenna, the minimum physical antenna dimension (or the electrically effective minimum dimension) must be on the order of a quarter wavelength (or a multiple thereof) of the operating frequency, which thereby advantageously limits the energy dissipated in resistive losses and maximizes the energy transmitted. Quarter wave length and half wave length antennas are the most commonly used.

The burgeoning growth of wireless communications devices and systems has created a substantial need for physically smaller, less obtrusive, and more efficient antennas that are capable of wide bandwidth or multiple frequency-band operation, and/or operation in multiple modes (i.e., selectable radiation patterns or selectable signal polarizations). Smaller packaging of state-of-the-art communications devices, such as handsets, does not provide sufficient space for the conventional quarter and half wave length antenna elements. Thus physically smaller antennas operating in the frequency bands of interest, and providing the other desired antenna operating properties (input impedance, radiation pattern, signal polarizations, etc.) are especially sought after.

As is known to those skilled in the art, there is a direct relationship between physical antenna size and antenna gain, at least with respect to a single-element antenna, according to the relationship: gain=$(\beta R)^2+2\beta R$, where R is the radius of the sphere containing the antenna and $\beta$ is the propagation factor. Increased gain thus requires a physically larger antenna, while users continue to demand physically smaller antennas. As a further constraint, to simplify the system design and packaging, and strive for minimum cost, equipment designers and system operators prefer to utilize antennas capable of efficient multi-band and/or wide bandwidth operation, to allow the communications device to access various wireless services operating within different frequency bands from a single antenna. Finally, gain is limited by the known relationship between the antenna frequency and the effective antenna length (expressed in wavelengths). That is, the antenna gain is constant for all quarter wavelength antennas of a specific geometry i.e., at that operating frequency where the effective antenna length is a quarter wavelength of the operating frequency.

One basic antenna commonly used in many applications today is the half-wavelength dipole antenna. The radiation pattern is the familiar omnidirectional donut shape with most of the energy radiated uniformly in the azimuth direction and little radiation in the elevation direction. Frequency bands of interest for certain communications devices are 1710 to 1990 MHz and 2110 to 2200 MHz. A half-wavelength dipole antenna is approximately 3.11 inches long at 1900 MHz, 3.45 inches long at 1710 MHz, and 2.68 inches long at 2200 MHz. The typical antenna gain is about 2.15 dBi.

The quarter-wavelength monopole antenna placed above a ground plane is derived from a half-wavelength dipole. The physical antenna length is a quarter-wavelength, but when placed above a ground plane the antenna performance resembles that of a half-wavelength dipole. Thus, the radiation pattern for a monopole antenna above a ground plane is similar to the half-wavelength dipole pattern, with a typical gain of approximately 2 dBi.

The common free space (i.e., not above ground plane) loop antenna (with a diameter of approximately one-third the wavelength) also displays the familiar donut radiation pattern along the radial axis, with a gain of approximately 3.1 dBi. At 1900 MHz, this antenna has a diameter of about 2 inches. The typical loop antenna input impedance is 50 ohms, providing good matching characteristics. However, conventional loop antennas are too large for handset applications and do not provide multi-band operation.

A hula hoop antenna is one version of a transmission line antenna, defined as a conductive element over a ground plane. The loop is basically inductive and therefore includes a capacitor at one end connected to the ground plane to create a resonant structure. The other end serves as the feed point for the received or transmitted signal.

Printed or microstrip antennas are constructed using the principles of printed circuit board techniques, where the metallization layer is the radiating element. These antennas are popular because of their low profile, the ease with which they can be formed and a relatively low fabrication cost. One such antenna is the patch antenna, comprising a ground plane overlying a dielectric substrate, with the radiating element overlying the top substrate surface. The patch antenna provides directional hemispherical coverage with a gain of approximately 3 dBi. Although small compared to a quarter or half wavelength antenna, the patch antenna has a relatively poor radiation efficiency, i.e., the resistive return losses are relatively high. Disadvantageously, the patch antenna exhibits a relatively narrow bandwidth.

So called frequency independent antennas are loosely defined as those antennas having a bandwidth of about 10:1. The ideal frequency-independent antenna has a constant pattern, impedance, polarization and phase center over a wide frequency band. Spiral and sinuous antennas are examples of frequency independent antennas.

Given the advantageous performance of quarter and half wavelength antennas, conventional antennas are typically constructed so that the antenna length is on the order of a quarter wavelength of the radiating frequency, and the antenna is operated over a ground plane. These dimensions allow the antenna to be easily excited and operated at or near a resonant frequency, limiting the energy dissipated in resistive losses and maximizing the transmitted energy. But, as the operational frequency increases/decreases, the operational wavelength decreases/increases and the antenna element dimensions proportionally decrease/increase.

Each of the many antenna configurations discussed above have certain advantageous features, but none offer all the performance requirements desired for handset and other wireless applications, including dual or multi-band operation, high radiation efficiency, high gain, low profile and low fabrication cost.

BRIEF SUMMARY OF THE INVENTION

The present invention comprises a multi-band antenna (i.e., operative or resonant in more than one frequency band). The antenna comprises conductive material having a spiral shape and a ground plane spaced apart from the conductive material. A shorting leg extends from the conductive material and is connected to a ground plane. The signal feed leg extends from the conductive material. The signal feed leg provides the signal to the antenna for transmission in the transmitting mode and provides the received signal to receiving equipment in the receiving mode. Advantageously, the antenna provides multiple resonant frequencies in a relatively small volume for use with communications devices, especially handset devices.

BRIEF DESCRIPTION OF THE DRAWINGS

The foregoing and other features of the invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DETAILED DESCRIPTION OF THE INVENTION

Figure 1:
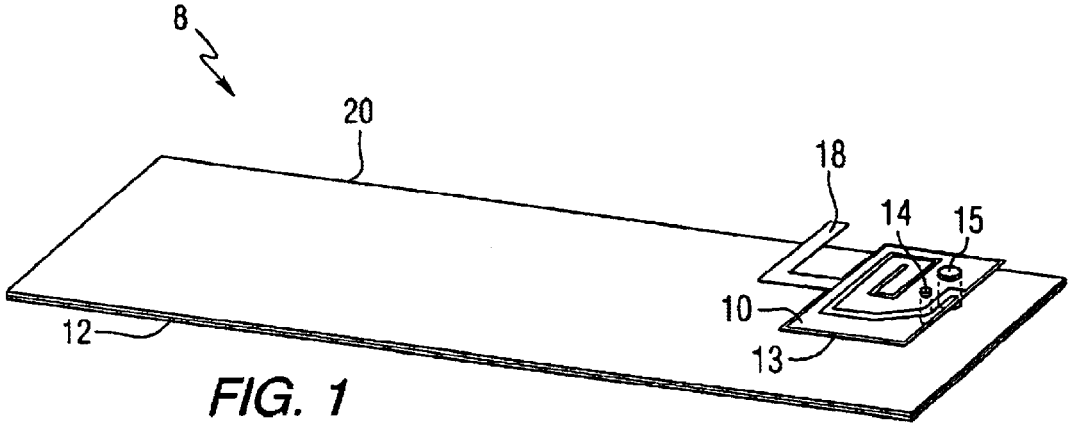
FIG. 1 is a perspective view of an antenna constructed according to one embodiment of the present invention.

Before describing in detail the particular antennas in accordance with the various embodiments of the present invention, it should be observed that the present invention resides primarily in a novel combination of hardware elements related to antennas. Accordingly, the hardware elements have been represented by conventional elements in the drawings, showing only those specific details that are pertinent to the present invention, so as not to obscure the disclosure with structural details that will be readily apparent to those skilled in the art having the benefit of the description herein.

The dual loop or dual spiral antenna according to one embodiment of the present invention improves on the antennas of the prior art, especially for handset and wireless operation, offering dual band operation (in one embodiment, the antenna operates in the industrial, scientific and medical frequency band (ISM) of 2.4 to 2.5 GHz and in the HiperLAN2 band of about 5 GHz for wireless communications). The antenna also provides high radiation efficiency in both bands, high gain, a low profile and a low fabrication cost. The antenna also offers a wide operational bandwidth.

It is known that loop antennas of the prior art having their electric field component parallel to a lossy ground plane (for example, the magnesium case of a laptop computer) exhibit poor performance and reduced bandwidth. The present antenna design limits the interaction between the radiator and the ground plane to improve the performance and limit the bandwidth reduction. As a result, an antenna of the present invention is more suitable for use in a laptop case (installed on a PCMCIA card, for example) than those of the prior art.

As shown in FIG. 1, an antenna 8 comprises a radiator 10 over a ground plane 12. In one embodiment, the ground plane 12 comprises two sheets of conductive material separated by a dielectric substrate. In another embodiment a single sheet of conductive material suffices as the ground plane. The radiator 10 is disposed substantially parallel to and a spaced apart from the ground plane 12, with an air dielectric gap 13 therebetween. In another embodiment a dielectric material other than air is disposed within the gap 13, changing the antenna operational parameters in accordance with the properties of the dielectric material. In one embodiment the distance between the ground plane 12 and radiator 10 is about 5 mm.

Although the ground plane 12 is shown as a flat, grounded surface in FIG. 1, depending on the application, the ground plane 12 can comprise a ground trace on a printed circuit board. In a laptop computer installation for the antenna 8, the ground plane 12 can comprise the laptop case.

A feed pin 14 and a ground pin 15 are also illustrated in FIG. 1. One end of the feed pin 14 is electrically connected to a feed trace 18 extending to an edge 20 of the ground plane 12. A connector (not shown in FIG. 1), is connected to the feed trace 18 for providing a signal to the antenna 8 in the transmitting mode and responsive to a signal from the antenna 8 in the receiving mode. As is known, the feed trace 18 is insulated from the grounded surface of the ground plane 12. The opposing end of the feed pin 14 is electrically connected to the radiator 10.

The ground pin 15 is connected between the radiator 10 and the ground plane. Both the feed pin 14 and the ground pin 15 are formed from hollow or solid copper rods.

Figure 2:
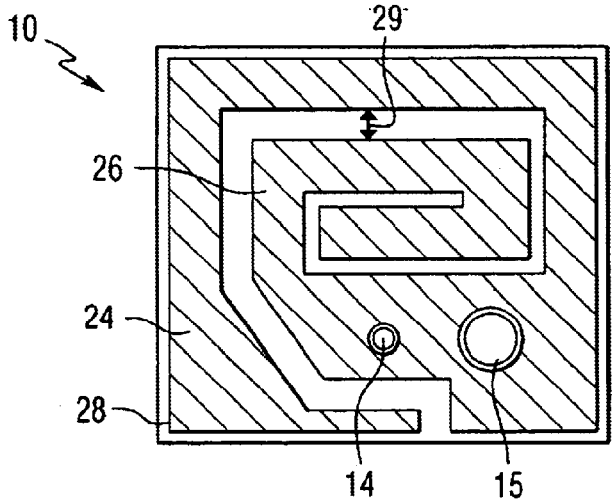
FIG. 2 is a top view of the antenna of FIG. 1.

As illustrated in FIG. 2, the radiator 10 comprises two coupled and continuous loop conductors (also referred to as spirals or spiral segments) 24 and 26 disposed on a dielectric substrate 28. The outer loop 24 is the primary radiating region and exercises primary control over the antenna resonant frequency. The inner loop 26 primarily affects the antenna gain and bandwidth. Although the inner and outer loops 24 and 26 are described in terms of their primary effect on the antenna performance parameters, it is known that realistically these influences are not independent nor divisible. There is substantial interdependence, although as discussed below, some degree of independence and therefore independent control over the resonant frequencies, is attainable.

The specific loop patterns illustrated for the outer and the inner loops 24 and 26, respectively, in FIG. 2 are merely exemplary and can be varied to achieve other desirable antenna characteristics, for example to change the resonant frequencies of the two operational frequency bands. The spacing between the outer and inner loops 24 and 26, as represented by a reference character 29 in FIG. 2, can be varied along the spiral path separating the loops 24 and 26, thereby changing the operating characteristics of the antenna 8. In one embodiment, the outer and inner loops 24 and 26 (i.e., the radiator 10) are formed on the dielectric substrate 28 by known masking, patterning and etching processes. In another embodiment the radiator 10 is formed from a conductive sheet by known stamping or etching processes.

Exemplary dimensions and operating characteristics for one embodiment of the antenna 8 are as follows.

Antenna size: 0.7511×0.84"×0.01"

Dual band frequencies: 2.45 GHz (IEEE 802.11a band) and 5.25 GHz (IEEE 802.11b band)

Gain: +2.3 dBi peak gain in the 2.45 GHz band +4.6 dBi peak gain at 5.25 GHz band Bandwidth: 100 MHz at 2.45 GHz band (VSWR<2:1) 200 MHz at 5.25 GHz band (VSWR<2:1)

Radiation efficiency: +69% in the 2.45 GHz band +65% in the 5.25 GHz band

Pattern: Hemispherical

Figure 3:
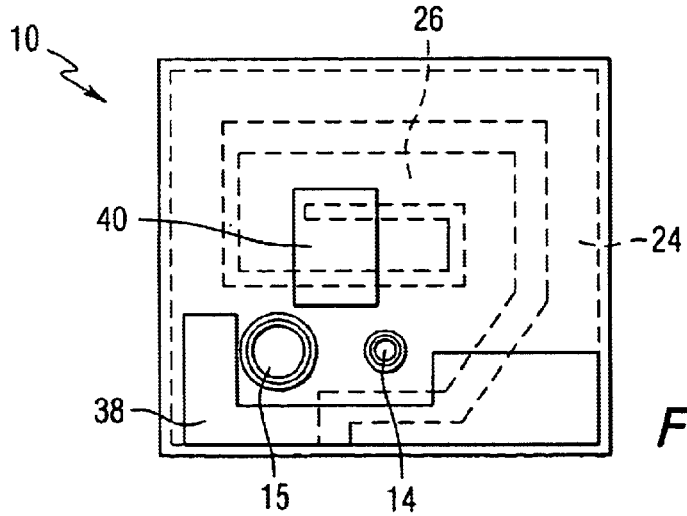
FIG. 3 is a bottom view of the antenna of FIG. 1.

As discussed above, the antenna 8 exhibits two loosely coupled resonant frequencies, one determined primarily by outer loop parameters and the other primarily by inner loop parameters. One resonant frequency is controlled by the size of the outer loop 24 (which is one factor that determines the outer loop inductance), the capacitance loading of the outer loop 24 and the inductive coupling to the inner loop 26. In one embodiment this capacitance is controllable by positioning a conductive plate 38 on the bottom surface of the radiator 10. See the bottom view of FIG. 3. The plate 38 underlies regions of the outer loop 24 to effect the capacitance between the overlying regions of the outer loop 24. The plate 38 can be trimmed and/or positioned until the desired capacitance value and thus the desired antenna performance characteristics are achieved.

The resonance of the inner loop 26 is governed by its size and proximity to the outer loop 24 (i.e., inductive coupling between the loops), as well as the capacitance between regions of the inner loop 26, which is controllable according to the size, shape and position of a plate 40 disposed below regions of the inner loop 26. See FIG. 3.

Because the outer and inner loops 24 and 26 are tunable based on the size and placement of the plates 38 and 40 and the inductive coupling between the loops as determined by the distance between the outer and inner loops 24 and 25, the loop resonant frequencies are, to some extent, independently controllable. For example, increasing the capacitance of the outer loop 24 by adjustment of the plate 38, lowers the upper resonant frequencies of the antenna 8. Changing the capacitance loading of the inner loop 26 (by adjusting the plate 40) affects the low resonant frequencies, but has less affect on the upper resonant frequency. Reducing the length of a loop also reduces the loop inductance and thus increases the resonant frequency associated with the loop.

It is also possible to achieve an overlap of the resonant frequencies associated with the outer and inner loops 24 and 26 by adjusting the end capacitances of either or both loops. This technique broadens the apparent VSWR (voltage standing wave ratio) bandwidth and also provides an antenna having better input impedance characteristics. Further, certain adjustments on the elements of the antenna 8 can create one or more additional resonant frequencies. Thus starting with the basic configuration of the antenna 8, one can modify the elemental dimensions and spacings and add or deduct capacitive and/or inductive reactance to achieve the desired antenna operational characteristics.

The outer and inner loops 24 and 26 shown in FIG. 1 can be either contra-wound (having opposed spirals) or wound in the same sense as illustrated in FIG. 2. In the contra-wound embodiment, wherein the spirals start at the origin in an opposed relationship then progress outwardly (for example, similar to the spiral loops of a galaxy of stars) loop currents flow in opposing directions.

The diameter and location of the ground pin 15 can also be modified to optimize antenna performance according to the end-use antenna requirements. The diameter of the ground pin 15 especially affects the antenna input characteristics. For a diameter of less than about 80 mils, the reflection characteristics (also referred to as the s11 parameters) the input bandwidth, the VSWR, and the radiation efficiency of the upper resonant frequencies (that is, the 5.25 GHz band) are generally acceptable. For a diameter of greater than about 160 mils the reflection characteristics, input bandwidth, VSWR, and radiation efficiency of the lower resonant frequencies (that is, the 2.45 GHz band) are generally acceptable. For a diameter of between about 120 to 140 mils the antenna exhibits relatively good balanced performance at both the upper and the lower resonant frequencies. Thus the antenna performance can also be tuned by adjusting the diameter of the ground pin 15.

Changing the distance between the ground pin 15 and the feed pin 14 primarily affects the lower resonant frequencies and the antenna input characteristics. Reducing the distance between the ground plane 12 and the radiator 10 (the gap 13) raises the depth of the return loss nulls and therefore raises the VSWR. This in turn reduces the bandwidth, as the band of frequencies where the return loss is below a specified value is reduced. Thus, once the desired antenna performance parameters are known, the location and diameter of the ground pin 15 and the feed pin 14 can be adjusted to achieve the desired performance.

Figure 4:
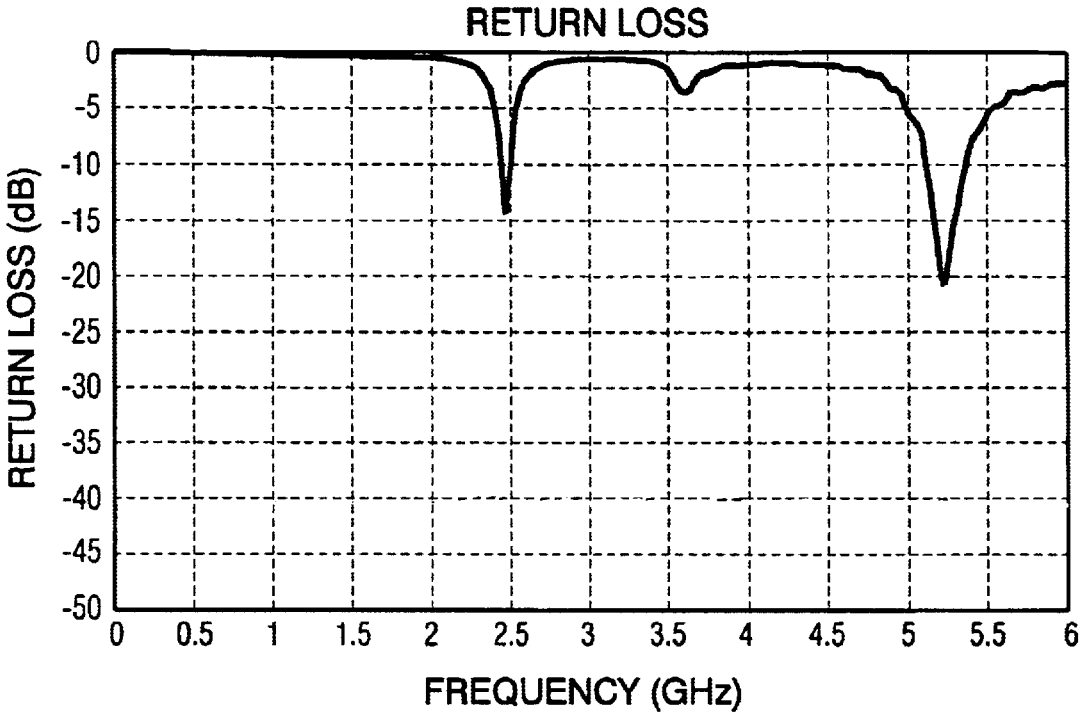
FIG. 4 is a graph illustrating the return loss of the antenna of FIG. 1.

FIG. 4 illustrates the input return loss characteristics for a dual-band implementation of the antenna 8 of the present invention operative within the 2.45 GHz and 5.25 GHz bands.

One technique for forming the feed pin 14 and the ground pin 15 is described below. In this embodiment, the radiator 10 is formed on a thin 0.010" flexible substrate connected to the ground plane 12 through a 0.140" diameter ground pin 15. A 0.050" diameter feed pin 14 is connected to the feed trace 18 and the radiator 10. A rivet operation to attach the feed pin 14 and the ground pin 15 is a cost effective technique. Use of a temporary spacer within the gap 13, advantageously one that is capable of surviving infrared solder reflow process temperatures, ensures accurate vertical spacing between the radiator 10 and the ground plane 12.

In one embodiment, the following process steps are executed to install the feed and ground pins 14 and 15, respectively.

Figure 5:
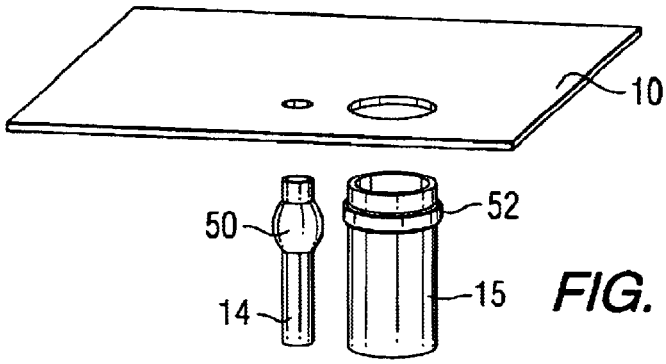
FIGS. 5 through 8 illustrate the assembly of certain pins associated with the antenna of FIG. 1.
Figure 6:
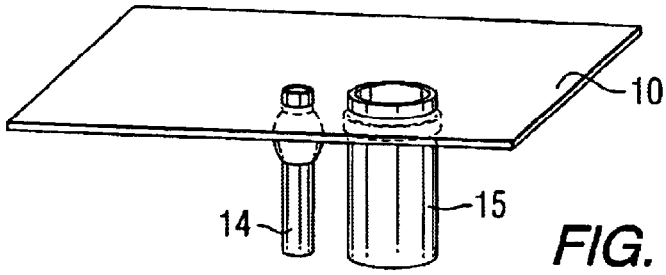
Figure 7:
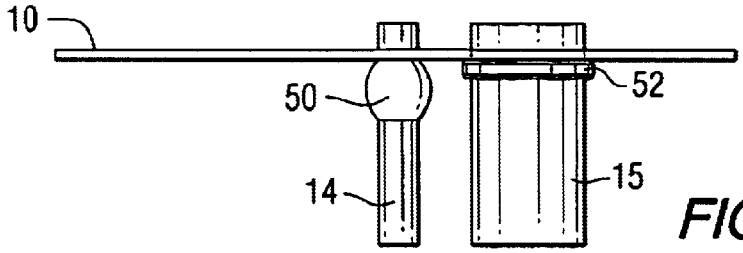

1) In one embodiment, two rivets form the 0.140" diameter ground pin 15 and the 0.050" diameter signal or feed pin 14, both of which are stamped to form collars 50 and 52, wherein the collar 50 is formed at a spaced apart location from an end of the feed pin 14, and the collar 52 is formed at a spaced apart position from an end of the ground pin 15. The collars 50 and 52 control the distance the feed pin 14 and the ground pin 15 extend above the radiator 10 when the collars 50 and 52 are urged against the bottom surface of the radiator 10. See FIG. 5. FIGS. 6 and 7 illustrate the feed and ground pins 12 and 15 mated with the radiator 10. In another embodiment the collars 50 and 52 can be separately formed and affixed to their respective pins 14 and 15 in an initial process step.

Figure 8:
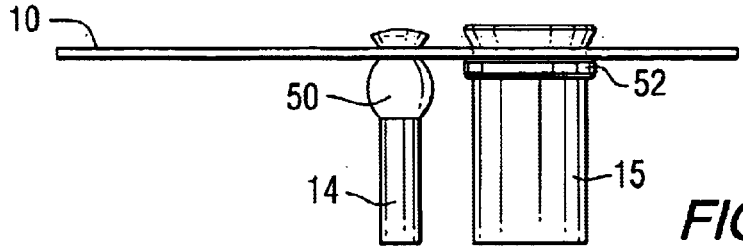

2) Next, the upper ends of the pins 14 and 15 are held in a fixture (not shown), and struck by tool that swages the pin material protruding above the radiator 10. See FIG. 8. This process locks the feed and ground pins 14 and 15 into position; they are then soldered to the radiator 10 to ensure positive electrical contact.

Figure 9:
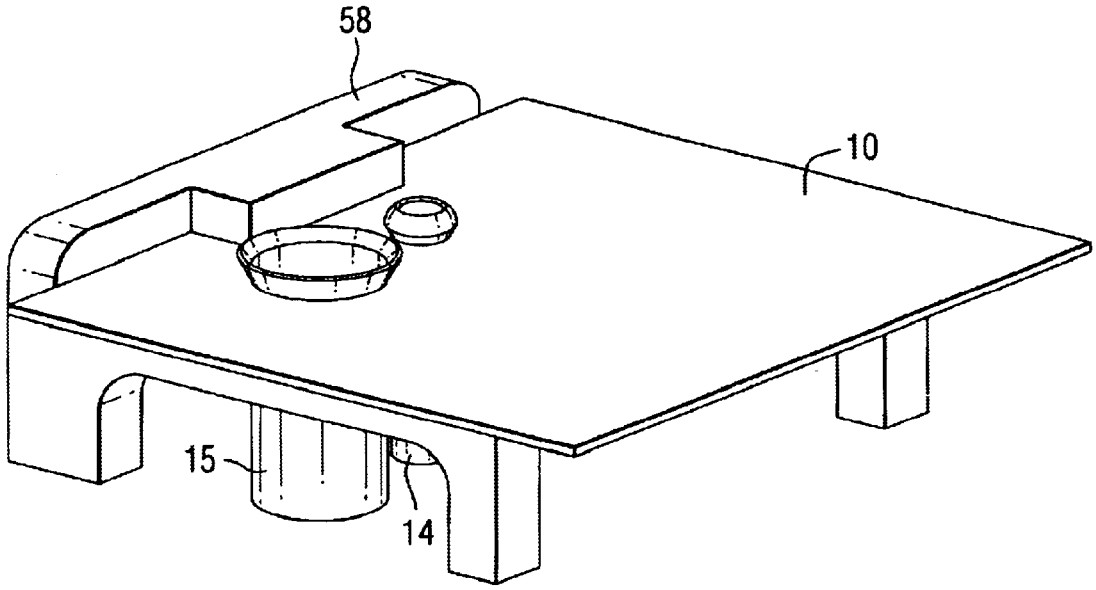
FIG. 9 is a perspective view of the antenna of FIG. 1 during the assembly process.

3) The assembly is mated to a high-temperature plastic spacer 58, held in place as shown by an interference fit. See FIG. 9.

Figure 10:
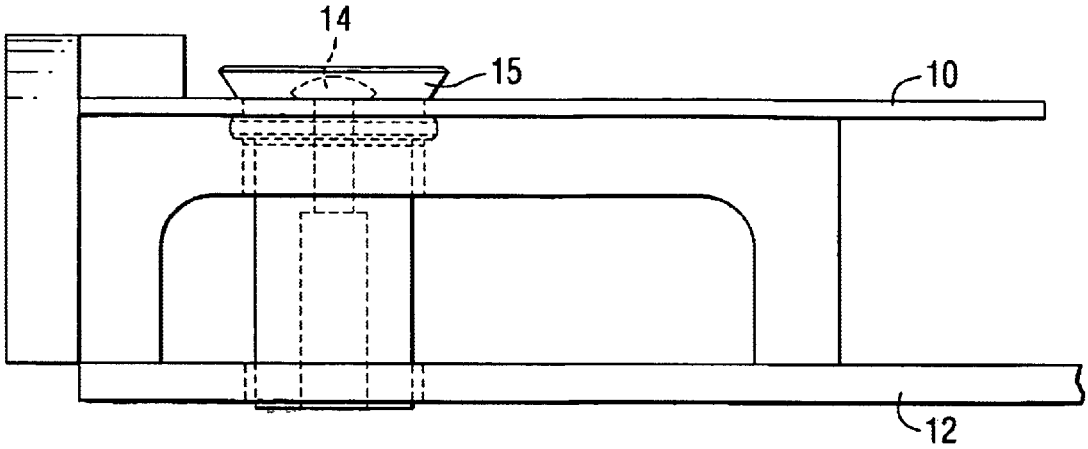
FIG. 10 is a side view of the antenna of FIG. 1 during the assembly process.

4) During the assembly process of affixing the radiator 10 to the ground plane 12, the spacer 58 maintains the proper distance between these two elements. The feed pin 14 and the ground pin 15 extend through mating holes in the ground plane 12, allowing for a strong solder joint between the pins and the ground plane 12. See FIG. 10. Once the radiator 10 is attached to the ground plane 12 (see FIG. 10), the spacer 58 is removed and discarded or returned to the antenna manufacturer.

Typically, the radiator/ground plane assembly is supplied by an antenna manufacturer to an original equipment manufacturer, who installs the assembly into a wireless product, such as a cellular phone handset or a laptop computer PCMCIA board.

Note that the design approach described above provides a positive mechanical joint between the feed/ground pins 14 and 15 and both the antenna radiator 10 and the ground plane 12. Two additional embodiments are described below for attaching the feed pin 14 and the ground pin 15 to the radiator 10.

The first alternative embodiment offers fewer processing steps and simpler, common parts (i.e., conductive pins or rods) that drop into mating holes in the radiator 10 and are then reflow soldered from the top surface of the radiator 10. The finished assembly according to this first alternative embodiment is illustrated in FIG. 11.

A second alternative embodiment includes a plurality of clip fingers 60 for affixing the feed pin 14 and the ground pin 15 to the radiator 10. The finger clips 60 urge the feed pin 14 and the ground pin 15 against the bottom surface of the radiator 10 and add strength to the final. assembly. In this embodiment both the feed pin 14 and the ground pin 15 are soldered in place from the top surface of the radiator 10.

Figure 11:
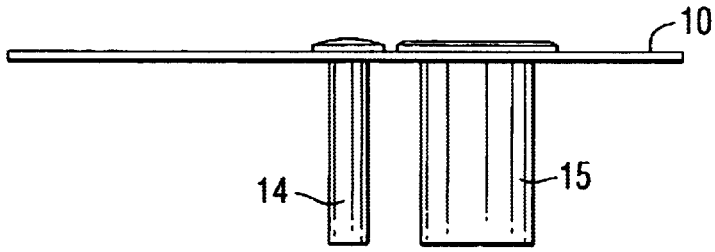
FIGS. 11 and 12 illustrate alternative assembly process for the pins of FIGS. 5 through 8.
Figure 12:
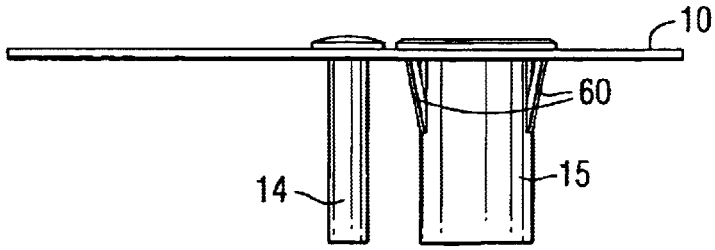

Both of subassemblies according to the FIGS. 11 and 12 embodiments are mated with the spacer 58 as described above for attachment of the feed and ground pins 14 and 15, respectively, to the ground plane 12. Although these alternatives provide a weaker solder-only mechanical fastening of the ground and signal pins 15 and 14 there is no adverse performance impact.

In another embodiment of the present invention, it is desirable to construct an antenna that is operative within the cellular service and personal communication service (PCS) bands of 824–894 MHz and 1850–1990 MHz, respectively. The antenna of this embodiment comprises a compact spiral shaped radiator providing optimum operating characteristics in a volume suitable for installation in handsets and other applications where space is at a premium. Since the antenna is constructed from a thin conductive material by stamping or etching, it can be bent to further reduce the volume and fit within the available space. The antenna feed and shorting pins are formed from the material of the radiator by the same stamping or etching techniques, thereby avoiding high cost and complexity. Since the antenna is constructed from a single conductive sheet, losses associated with dielectric material are avoided, resulting in increased radiation efficiency in both operational frequency bands. However, in another embodiment the antenna can be formed on a dielectric substrate, using known masking, patterning and etching steps. The antenna resonant frequencies are individually controllable by selecting the proper distance between the feed and shorting pins, and the proper shape of the radiator, as described below.

Figure 13:
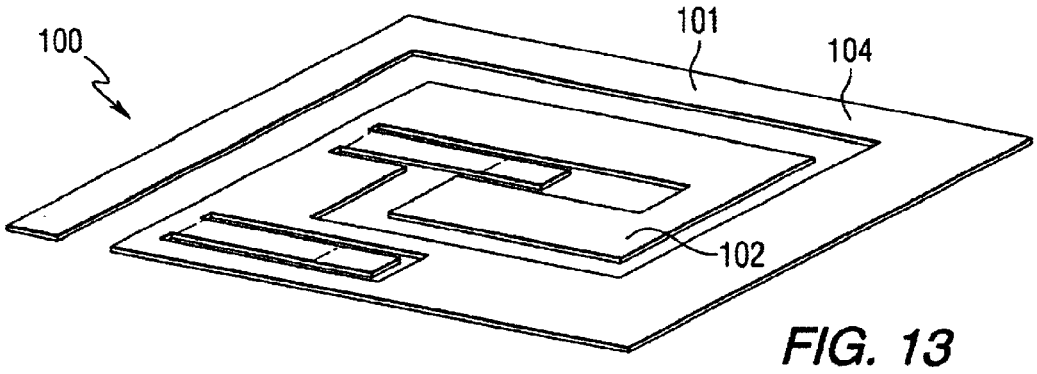
FIGS. 13 through 15 are perspective views of an antenna according to a second embodiment of the present invention.

One embodiment of such an antenna 100 is illustrated in the perspective view of FIG. 13. The antenna 100 is constructed from a sheet of relatively thin conductive material (copper, for example) and comprises a radiator 101 having a generally spiral shape. For the purpose of convenient reference, the spiral shape can be considered as comprising an inner spiral segment (or loop) 102 and an outer spiral segment (or loop) 104, although it is known that there is no physical line of demarcation between the inner and outer spiral segments 102 and 104, rather these references relate generally to approximate regions of the radiator 101.

In one embodiment, the radiator 101 is formed by a stamping or etching process, during which a feed pin 110 and a ground or shorting pin 112 are formed in the plane of the radiator 101. Generally, the feed pin 110 is positioned at a greater distance from the center of the radiator 101 than the ground pin 112.

Figure 14:
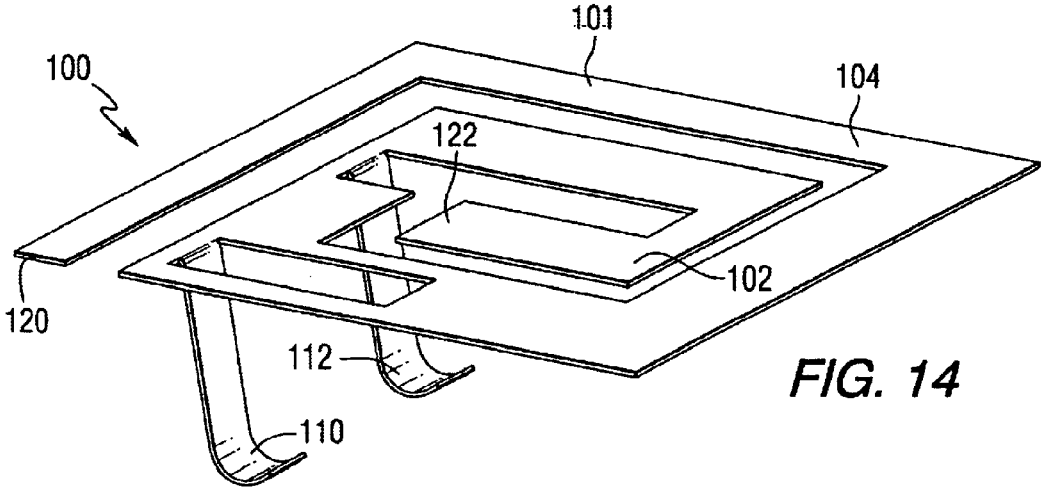

When installed in a communications device, the feed pin 110 is bent downwardly from the plane of the antenna 100 as illustrated in FIG. 14. A signal is fed to or received from the antenna 100 via the feed pin 110 when in electrical conduction with a feed element of the communications device, such as a printed circuit board trace. The shorting pin 112 is likewise bent downwardly and connected to a ground connection of the communications device. Physical touch soldering can be used to attach the feed pin 110 and the shorting pin 112 to their respective conductive elements of the communications device.

Figure 15:
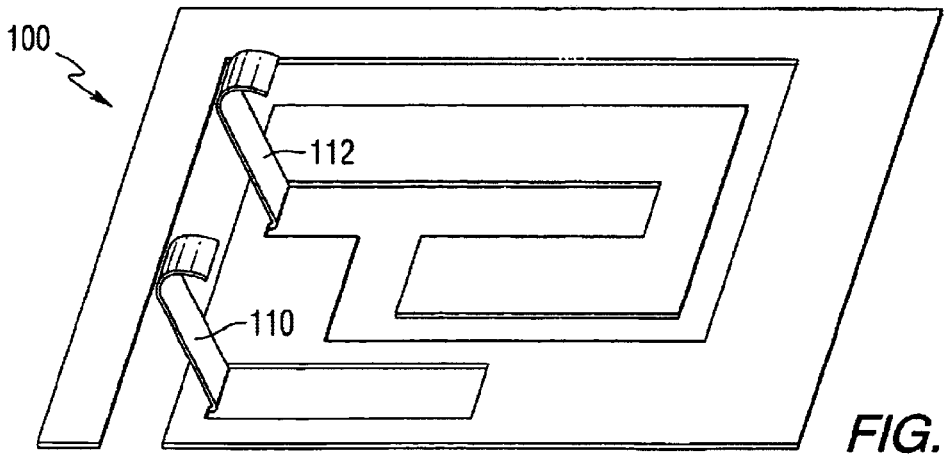

FIG. 15 is a bottom perspective view of the antenna 100, showing the same components as illustrated in FIG. 14.

The location of the feed pin 110 and the shorting pin 112 influences the operative resonant frequencies of the antenna 100. In a preferred embodiment, the antenna 100 operates in the cellular band (824–894 MHz) and in the personal communications band (1850–1990 MHz). Changing the distance between the feed pin 110 and the ground pin 112, and changing the distance between these pins and the perimeter of the radiator 101 provides operation at other frequencies. As discussed further below, variation of other structural parameters of the antenna 100 also produces a change in the antenna characteristics.

Figure 16:
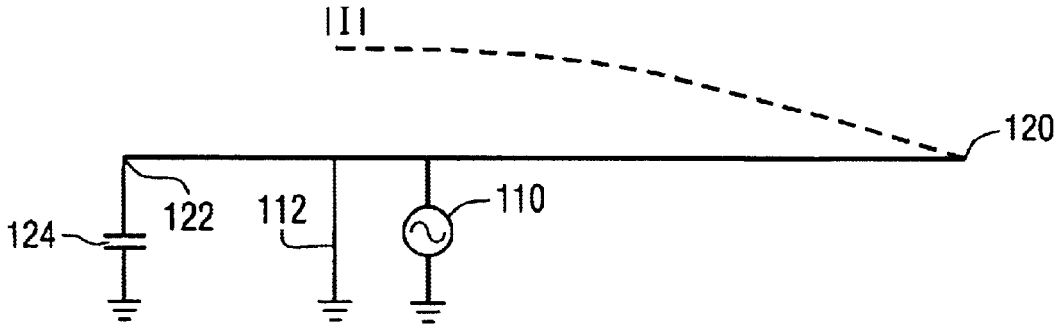
FIGS. 16 and 17 illustrate the current distribution of the antenna of FIGS. 13 through 15.

FIG. 16 illustrates an equivalent circuit for the antenna 100 during operation in the low frequency band, i.e., the cellular band. The physical location of an outer edge 120 and a center location 122 of the radiator 101 are indicated in FIG. 14. An equivalent capacitor 124 represents the capacitance between the center location 122 and ground. The majority of the current flows between the shorting pin 112 and the outer edge 120. Since the voltage at the shorting pin 112 is zero, the current magnitude is a maximum at that point, as illustrated in FIG. 16. Also, since the outer edge 120 is an open, the current magnitude is minimal there. Thus the current magnitude is distributed along the radiator 101 as shown in FIG. 16, forming a half-wave current distribution (i.e., a half wavelength) between the shorting pin 112 and the outer edge 120. Thus the low resonant frequency is primarily determined by the electrical length of the radiator 101 between the shorting pin 112 and the outer edge 120.

Figure 17:
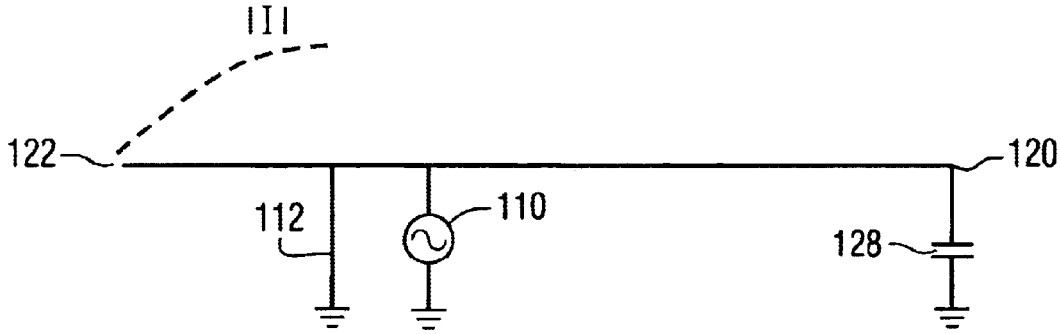

In the PCS frequency band (the high frequency band) the current in the radiator 101 flows primarily between the shorting pin 112 and the center location 122, as illustrated in FIG. 17. Within this distance the current cycle is a half wavelength as shown. Thus the performance in this high band is determined primarily by the electrical length of the radiator 101 between the shorting pin 112 and the center location 122. An equivalent capacitor 128 represents the capacitance between the outer edge 120 and ground.

The equivalent capacitors 124 and 128 affect the current flow on the radiator 101 and thus tune the radiator 101 to the appropriate frequency and limit the return loss (s11). Although these capacitors represent the inherent capacitance between elements of the antenna 100, they can be varied by changing the distance between the capacitor plates (the radiator 101 and the ground plane (not shown in FIGS. 16 and 17) or the dielectric material between the capacitor plates to affect the antenna performance characteristics.

Each of the resonant frequencies of the antenna 100 can also be adjusted using one or more of the following techniques. The ratio between the high and low resonant frequencies is inversely proportional to the distance between the shorting pin 112 and the feed pin 110. For example, the ratio of the center of the PCS band (1900 MHz) and center of the cellular band (850 MHz) is about 2.2. In one embodiment the distance between the shorting pin 112 and the feed pin 110 is about 0.35 inches. If this distance is increased, the ratio between the two band centers decreases. Likewise, if the distance is decreased, the ratio between the band centers increases.

Figure 18:
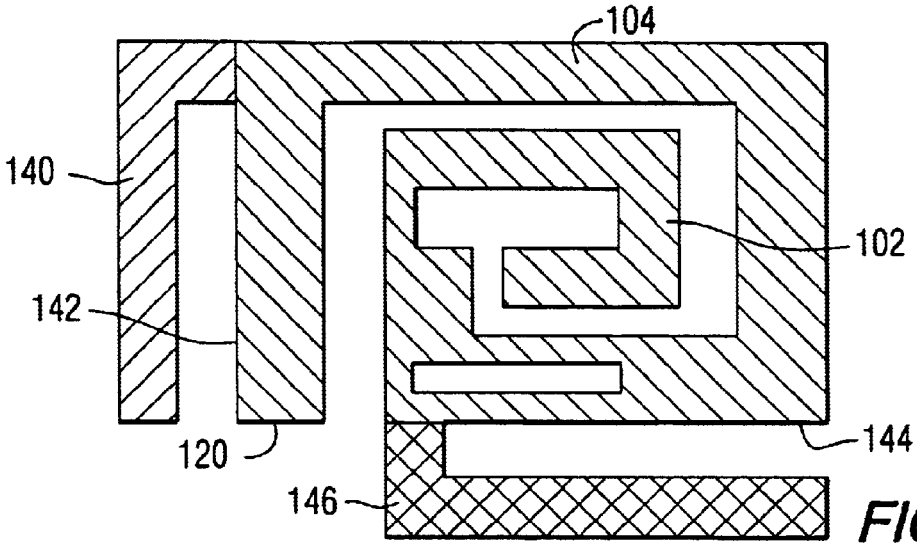
FIGS. 18 through 20 are top views or alternative embodiments of the antenna of FIGS. 13 through 15.

In another embodiment, the resonant frequencies can be controlled by adding additional conductive area to selected regions of the radiator 101. For example, in one embodiment a conductive polygon 140 is added to the radiator 101 beyond an outside edge 142 as shown in FIG. 18. Adding the conductive polygon 140 at this location affects only the low band performance by extending the electrical length of the radiator 101 between the shorting pin 112 and the outer edge 120, thereby lowering the low band resonant frequency. Similarly, shortening the distance between the shorting pin 112 and the outer edge 120, by removing a region of the radiator 101, increases the low band resonant frequency.

A conductive polygon 146 affixed proximate an edge 144 of the radiator 101, as illustrated in FIG. 18, adds electrical length to the radiator 101 between the shorting pin 112 and the center location 122, thus lowering the high band resonant frequency. Similarly, shortening the radiator 101 in the center region of the radiator 101 raises the high band resonant frequency.

Figure 19:
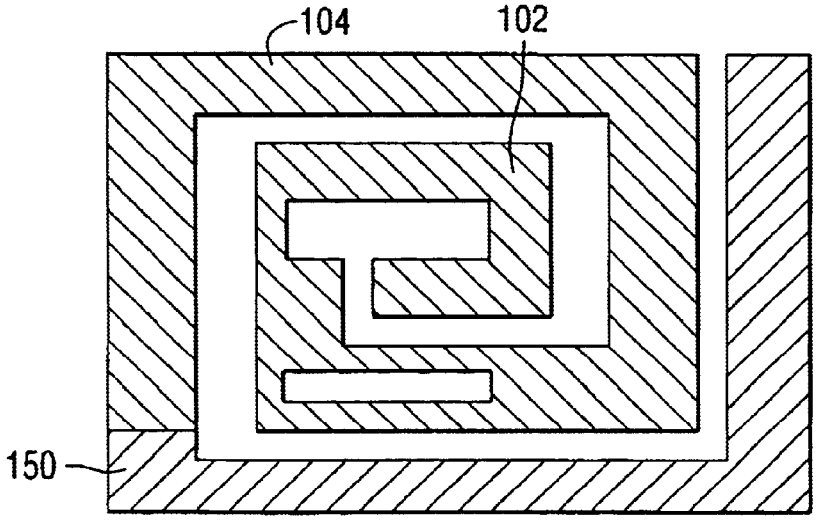

Changing the shape of the radiator 101 by adding an additional spiral segment 150 (that is, increasing the number of spiral turns), as illustrated in FIG. 19, decreases the low resonant frequency.

Figure 20:
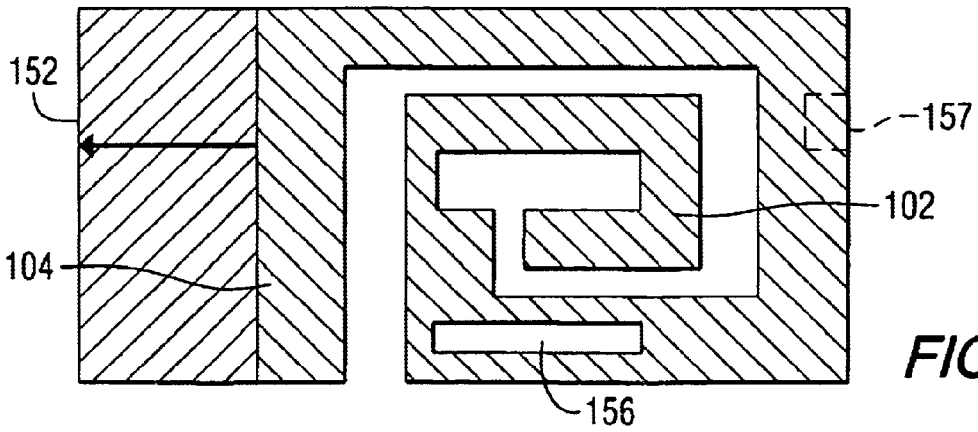

As illustrated in FIG. 20, increasing the width of the of the outer spiral segment 104 to a boundary 152 also lowers the low resonant frequency of the antenna 100.

Openings and/or notches can be formed in one or both of the inner and the outer spiral segments 102 and 104 for changing the antenna operating characteristics. For example, the size of an opening 156 in FIG. 20 can be increased or decreased to effect changes in operational parameters. An exemplary notch 157, shown in phantom in FIG. 20, can be sized and positioned to effect changes in operational parameters.

Figure 21:
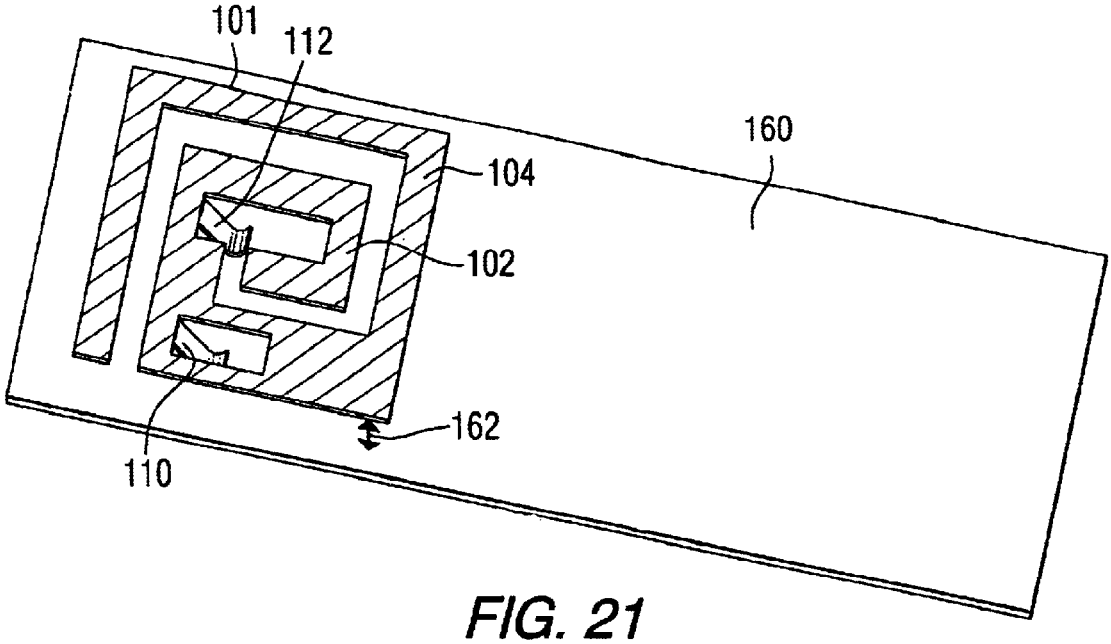
FIG. 21 is a perspective view of the antenna of FIGS. 13 through 15 disposed over a ground plane.

As discussed above, the antenna 100 is installed above a ground plane 160 as illustrated in FIG. 21. The length of a gap 162 dominates the input impedance and bandwidth of the antenna 100. As the gap 160 is increased, the bandwidth of both the high and low frequency bands increases. The resonant frequencies in the high and low bands are not significantly effected by the gap distance.

Thus, as discussed herein, it is seen that changing the capacitance and/or inductance of and between the inner and the outer spiral segments 102 and 104 causes modifications to the antenna operating parameters. Inductance includes both the mutual inductance between the inner and the outer spiral segments 102 and 104, and the self-inductance of the inner and the outer spiral segments 102 and 104. The capacitance and inductance changes can be accomplished by changing the various distances and areas associated with the elements of the antenna 100 according to the teachings presented herein and other obvious variants thereof.

In one embodiment, the antenna 100 is approximately 1.2 inches by 0.83 inches, but the design presents electrical lengths that are much greater than the physical dimensions, resulting in the aforementioned band resonances.

Note that in the embodiment of FIG. 13 the inner and outer spiral segments 102 and 104 are in a counter-clockwise orientation. If the shorting pin 110 and the feed pin 112 are bent upwardly (rather than downwardly as illustrated in FIG. 14), the orientation of the inner and outer spiral segments 102 and 104, respectively are reversed to a clockwise orientation. However the performance characteristics associated with the clockwise spiral are substantially identical to the characteristics of the counter-clockwise spiral.

Exemplary dimensions and performance characteristics for the antenna 100 are as follows.

Antenna size: 1.2"×0.83"

Height above ground plane (gap 162): 0.32"

Gain: +1 dBi at the cellular frequencies +4.2 dBi at the PCS frequencies

Bandwidth: 70 MHz at cellular frequencies (VSWR<3:1) 140 MHz at PCS frequencies (VSWR<2:1)

Figure 22:
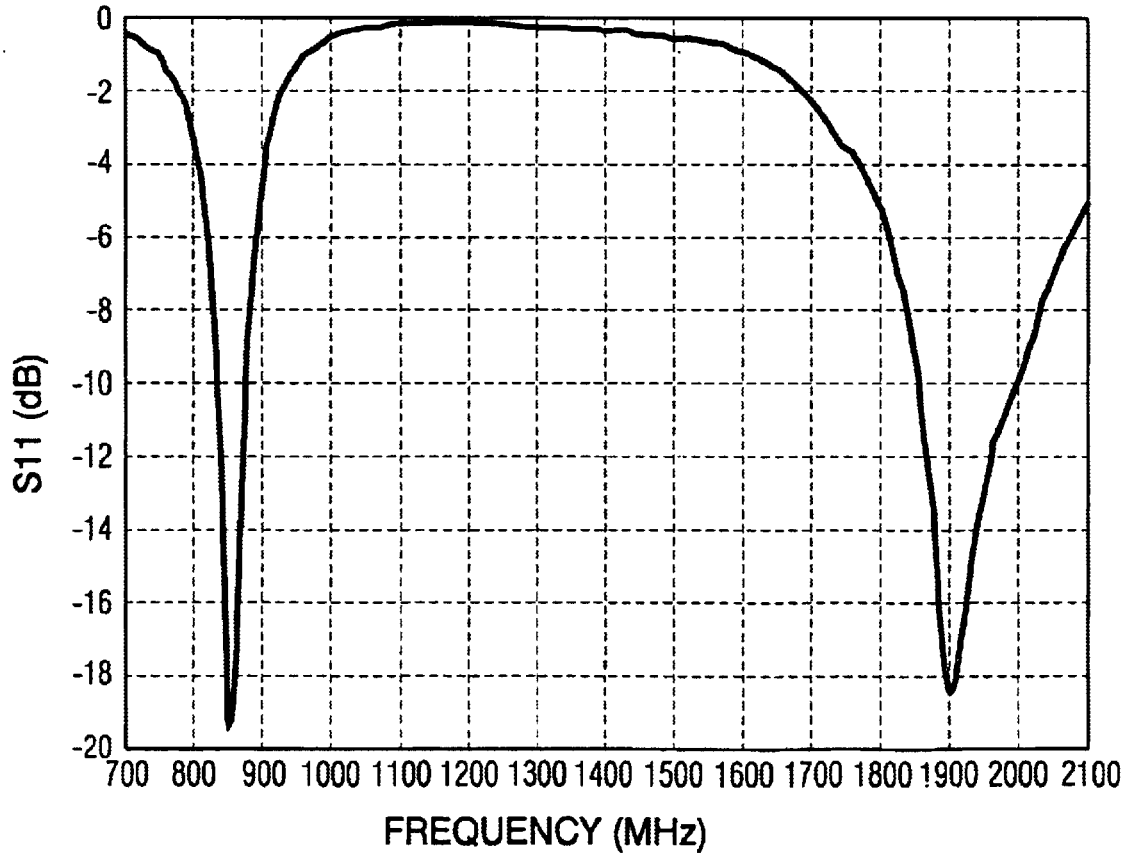
FIG. 22 is a graph illustrating the return loss of the antenna of FIGS. 13 through 15.

Radiation Efficiency: +66% at the cellular frequencies +78% at the PCS frequencies Pattern: Azimuthal omnidirectional An exemplary return loss graph for an antenna constructed according to the teachings of the present invention is illustrated in FIG. 22, showing the resonant condition at about 850 MHz and 1900 MHz.

Figure 23:
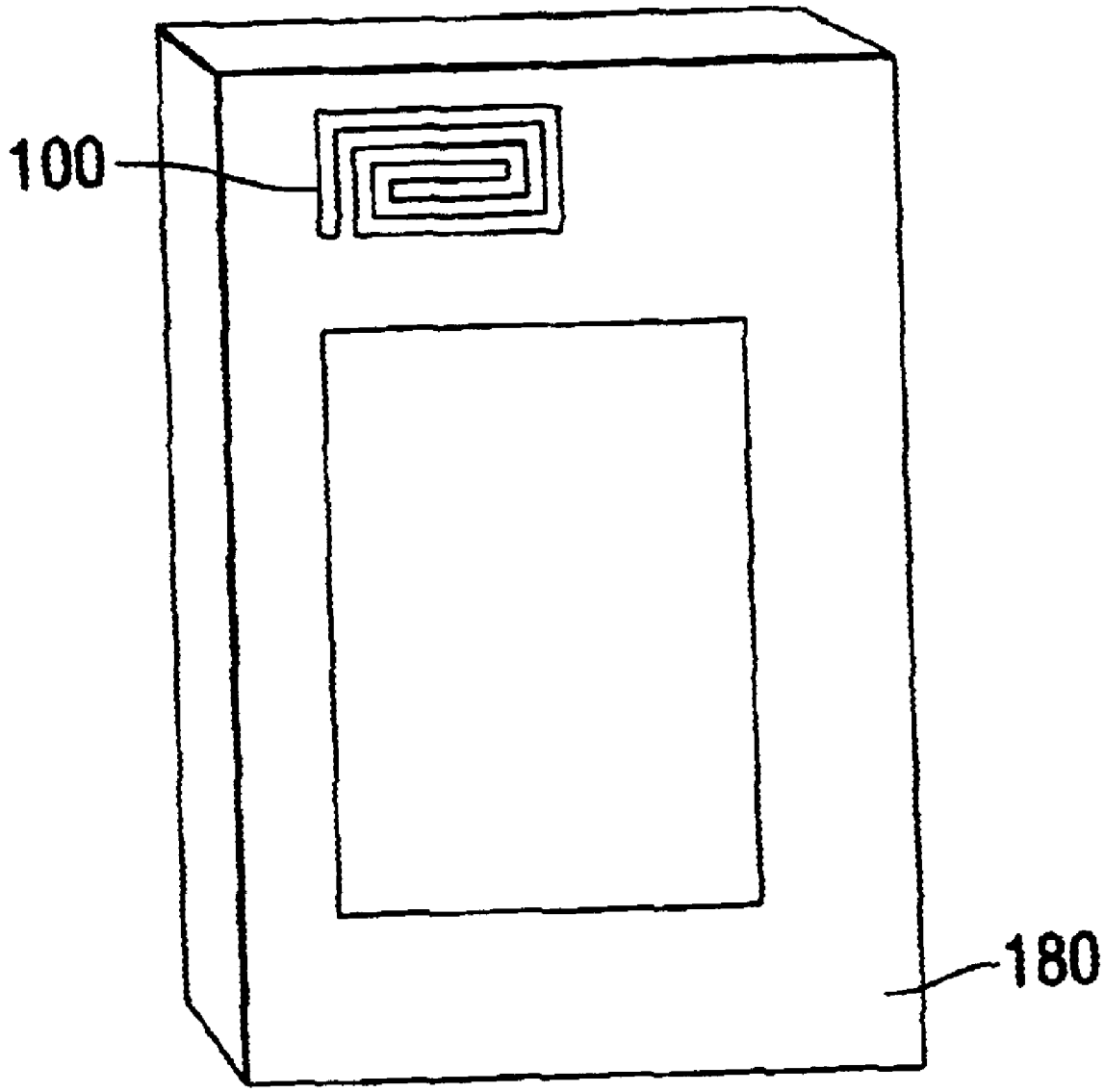
FIG. 23 is a communication device including an antenna constructed according to the teachings of the present invention.

FIG. 23 illustrates a communication device 180 including an antenna 100 constructed according to the teachings of the present invention.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt a particular application to the teachings of the present invention without departing from its essential scope thereof. For example, different sized and shaped radiator elements, resulting in different antenna performance parameters, than those discussed herein can be accommodated by appropriate modifications to the teachings of the present invention.

Therefore, it is intended that the invention not be limited to the particular embodiment disclosed as the best mode contemplated for carrying out this invention, but that the invention will include all embodiments falling within the scope of the appended claims.

What is claimed is:

1. An antenna comprising:

a conductive surface having a spiral shape;

a ground plane spaced apart from the conductive surface;

a shorting leg electrically connected to the conductive surface and extending from a plane of the conductive surface, and further having a distal end connected to the ground plane;

a signal feed leg electrically connected to the conductive surface and extending from the plane of the conductive surface; and wherein the conductive surface defines a first opening and a second opening disposed relative to the shorting leg and the signal feed leg, respectively such that if the shorting leg or the signal feed leg is pivoted into the plane of the conductive surface, the shorting leg or the signal feed leg is received into the first opening and the second opening, respectively.

2. The antenna of claim 1 wherein the shorting leg is positioned closer to the center of the conductive surface than the feed leg.

3. The antenna of claim 1 wherein at least a first and a second current resonant condition is established within the conductive surface such that the antenna is resonant at two spaced-apart resonant frequencies.

4. The antenna of claim 3 wherein the first current resonant condition is established between the shorting leg and an outer edge of the conductive surface, such that the first resonant condition determines a low resonant frequency for the antenna.

5. The antenna of claim 4 wherein modifying the effective electrical length of the conductive surface between the shorting leg and the outer edge changes the low resonant frequency.

6. The antenna of claim 3 wherein the second current resonant condition is established between the shorting leg and an inner region of the conductive surface, such that the second resonant condition determines a high resonant frequency for the antenna.

7. The antenna of claim 6 wherein the effective electrical length of the conductive surface between the shorting leg and the inner region is modified to change the high resonant frequency.

8. The antenna of claim 1 wherein the conductive surface comprises a radiator for receiving and transmitting electromagnetic radiation.

9. The antenna of claim 1 wherein the material of the conductive surface comprises copper.

10. The antenna of claim 9 for use with a communications device, wherein the antenna is disposed within a volume of the communications device.

11. The antenna of claim 1 wherein the conductive surface is substantially planar.

12. The antenna of claim 1 wherein a dielectric material is disposed within a gap formed between the conductive surface and the ground plane.

13. The antenna of claim 12 wherein the dielectric material is other than air.

14. The antenna of claim 1 wherein the conductive surface comprises an inner spiral segment and an outer spiral segment, and wherein the shorting leg extends from the region of he inner spiral segment.

15. The antenna of claim 1 wherein the conductive surface comprises an inner spiral segment and an outer spiral segment, and wherein the signal feed leg extends from the outer spiral segment.

16. The antenna of claim 1 wherein operational antenna parameters are responsive to one or more of a spiral shape area, a spiral shape configuration, the location and separation of the shorting and the feed legs, and the distance and dielectric material between the conductive surface and the ground plane.

17. The antenna of claim 1 wherein the spiral shape comprises a inner spiral segment and an outer spiral segment, wherein the inner spiral segment originates proximate the center of the conductive surface and extends outwardly therefrom in a spiral shape, and wherein the outer spiral segment is collinear with the inner spiral segment.

18. The antenna of claim 1 wherein the spiral shape comprises an inner spiral segment and an outer spiral segment, and wherein the operational characteristics of the antenna are responsive to the capacitance between the ground plane and the inner and the outer spiral segments, the inductance between the inner and the outer spiral segments and the inductance of the inner and the outer spiral segments.

19. The antenna of claim 18 wherein the inductance between the inner and the outer spiral segments is responsive to the distance between the inner and the outer spiral segments.

20. The antenna of claim 18 wherein the inductance of the inner and the outer spiral segments is responsive to the dimensions of the inner and the outer spiral segments.

21. The antenna of claim 1 exhibiting a high and a low resonant frequency, wherein the spiral shape comprises an inner region proximate the center of the conductive surface and an outer region proximate the outer periphery of the spiral shape, and wherein the low resonant frequency is altered by changing the conductive surface area in the outer region.

22. The antenna of claim 21 wherein the low resonant frequency decreases in response to enlarging the area of the conductive surface in the outer region, and wherein the low resonant frequency increases in response to reducing the area of the conductive surface in the outer region.

23. The antenna of claim 21 wherein the high resonant frequency decreases in response to enlarging the area of the conductive surface in the inner region, and wherein the high resonant frequency increases in response to reducing the area of the conductive surface in the inner region.

24. The antenna of claim 1 presenting a resonant condition in the cellular frequency band and in the personal communications frequency band.

25. The antenna of claim 1 wherein at least one resonant frequency of the antenna is responsive to the distance between the shorting leg and the signal feed leg.

26. The antenna of claim 1 wherein the spiral shape comprises an opening therein for effecting the antenna performance parameters.

27. The antenna of claim 1 wherein the spiral shape comprises a notch therein for effecting the antenna performance parameters.

28. An antenna comprising:

a conductive surface having a spiral shape;

a ground plane spaced apart from the conductive surface;

a shorting leg electrically connected to the conductive surface and extending from the a plane of the conductive surface, and further having a distal end connected to the ground plane;

a signal feed leg electrically connected to the conductive surface and extending from the plane of the conductive surface;

a substrate having a conductive layer overlying a dielectric layer, wherein the conductive surface is formed in the conductive layer, and wherein the spiral shape comprises an origin proximate the center of the conductive surface and a terminus proximate the perimeter of the conductive surface, and wherein the shorting leg comprises a substantially circular conductive element connected to the spiral shape between the origin and the terminus thereof, and wherein the signal feed leg comprises a substantially circular conductive element having a diameter smaller than the diameter of the shorting leg, and connected to the spiral shape between the shorting leg and the origin.

29. The antenna of claim 28 further comprising a conductive region underlying the dielectric layer, wherein the conductive region is disposed relative to the origin and the terminus of the spiral shape such that the performance characteristics of the antenna are responsive to the location of the conductive region.

30. The antenna of claim 28 presenting a resonant condition in the industrial, scientific and medical frequency band and in the HiperLAN2 frequency band.

31. A method for forming an antenna comprising:

forming a radiator by shaping a conductive material in a spiral configuration;

forming a first finger in the radiator by removing conductive material from a first region of the radiator so as to from the first finger therein, wherein three edges of the first finger are detached from the conductive material and the fourth edge of the first finger forms a first deformable joint with the conductive material;

forming a second finger in the radiator by removing conductive material from a second region of the radiator so as to form the second finger therein, wherein three edges of the second finger are detached from the conductive material and the fourth edge of the second finger forms a second deformable joint with the conductive material;

forming a shorting leg by bending the first finger along the first deformable joint such that the shorting leg extends downwardly from the plane of the radiator;

electrically connecting the shorting leg to a ground plane; and forming a signal feed leg by bending the second finger along the second deformable joint such the signal feed leg extends downwardly from the plane of the radiator.

32. The antenna of claim 31 wherein the shorting leg and the signal feed leg are substantially perpendicular to the plane of the radiator.

* * * * *